US005256519A

United States Patent [19]

Adin

[11] Patent Number: 5,256,519

[45] Date of Patent: Oct. 26, 1993

[54] NUCLEATED HIGH CONTRAST PHOTOGRAPHIC ELEMENTS CONTAINING TETRAAZAINDENES WHICH INHIBIT PEPPER FOG

[75] Inventor: Anthony Adin, Rochester, N.Y.

[73] Assignee: Eastman Kodak Company, Rochester, N.Y.

[21] Appl. No.: 844,337

[22] Filed: Mar. 2, 1992

[51] Int. Cl.[5] ..... G03C 1/06

[52] U.S. Cl. ..... 430/264; 430/598; 430/565

[58] Field of Search ..... 430/264, 598, 565

[56] References Cited

U.S. PATENT DOCUMENTS

| | | | |
|---|---|---|---|
| 4,166,742 | 3/1979 | Mifune et al. | 430/568 |
| 4,241,164 | 12/1980 | Mifume et al. | 430/264 |
| 4,311,781 | 8/1982 | Mifune et al. | 430/264 |
| 4,727,017 | 2/1988 | Pollet et al. | 430/264 |
| 4,728,601 | 3/1988 | Rowland et al. | 430/565 |
| 4,912,017 | 4/1990 | Takagi et al. | 430/264 |
| 4,920,034 | 8/1990 | Sasaoka et al. | 430/264 |
| 4,939,067 | 10/1990 | Takagi et al. | 430/264 |
| 4,975,354 | 12/1990 | Machonkin et al. | 430/264 |
| 4,978,603 | 2/1990 | Inoue et al. | 430/265 |
| 4,988,604 | 1/1991 | Machonkin et al. | 430/264 |
| 5,126,227 | 6/1992 | Machonkin et al. | 430/264 |

*Primary Examiner*—Charles L. Bowers, Jr.
*Assistant Examiner*—Thomas R. Neville
*Attorney, Agent, or Firm*—Alfred P. Lorenzo

[57] ABSTRACT

Silver halide photographic elements which are capable of high contrast development and are especially useful in the field of graphic arts have incorporated therein a hydrazine compound which functions as a nucleator, an amino compound which functions as an incorporated booster, and a 2-substituted-4-hydroxy-1,3,3a,7-tetraazaindene which functions to inhibit pepper fog.

19 Claims, No Drawings

NUCLEATED HIGH CONTRAST PHOTOGRAPHIC ELEMENTS CONTAINING TETRAAZAINDENES WHICH INHIBIT PEPPER FOG

FIELD OF THE INVENTION

This invention relates in general to photography and in particular to novel black-and-white photographic elements. More specifically, this invention relates to novel nucleated silver halide photographic elements which are capable of high contrast development and are especially useful in the field of graphic arts.

BACKGROUND OF THE INVENTION

U.S. Pat. No. 4,975,354 issued Dec. 4, 1990, entitled "Photographic Element Comprising An Ethyleneoxy-Substituted Amino Compound And Process Adapted To Provide High Contrast Development", by Harold I. Machonkin and Donald L. Kerr, describes silver halide photographic elements having incorporated therein a hydrazine compound which functions as a nucleator and an amino compound which functions as an incorporated booster. Such elements provide a highly desirable combination of high photographic speed, very high contrast and excellent dot quality, which renders them very useful in the field of graphic arts. Moreover, since they incorporate the booster in the photographic element, rather than using a developing solution containing a booster, they have the further advantage that they are processable in conventional, low cost, rapid-access developers.

A photographic system depending on the conjoint action of hydrazine compounds which function as nucleators and amino compounds which function as boosters is an exceedingly complex system. It is influenced by both the composition and concentration of the nucleator and the booster and by many other factors including the pH and composition of the developer and the time and temperature of development. The goals of such a system include the provision of enhanced speed and contrast, together with excellent dot quality and low pepper fog.

The goal of achieving low pepper fog is one which is exceptionally difficult to achieve without sacrificing other desired properties such as speed and contrast. (The term "pepper fog" is commonly utilized in the photographic art, and refers to fog of a type characterized by numerous fine black specks). A particularly important film property is "discrimination", a term which is used to describe the ratio of the extent of shoulder development to pepper fog level. Good discrimination, i.e., full shoulder development with low pepper fog, is necessary to obtain good halftone dot quality.

The use of ionizable thiones as antifoggants and/or stabilizers in nucleated high contrast films is disclosed in U.S. Pat. No. 4,166,742. The use of tetraazaindenes in nucleated high contrast films for such purposes as increasing sensitivity, enhancing emulsion stability, reducing fog formation and restraining grain growth is disclosed in numerous patents such as, for example, U.S. Pat. Nos. 4,241,164, 4,311,781, 4,912,017, 4,920,034, 4,939,067 and 4,978,603. Compounds which reduce pepper fog, however, often have an undesirably strong restraining action which leads to substantial undesired speed losses along with the desired pepper fog reduction.

The use of 2-substituted-4-hydroxy-1,3,3a,7-tetraazaindenes, in which the substituent at the 2-position is alkylthio or cycloalkylthio, as image toners in photographic materials is disclosed in U.S. Pat. No. 4,728,601. However, toning action is not related to ability to inhibit pepper fog.

The present invention is directed toward the objective of providing novel high contrast silver halide photographic elements which exhibit improved characteristics in regard to control of pepper fog, while still retaining excellent characteristics with respect to speed, contrast and full shoulder development.

SUMMARY OF THE INVENTION

It has now been found that certain 2-substituted-4-hydroxy-1,3,3a,7-tetraazaindenes are unexpectedly effective in alleviating pepper fog in nucleated high contrast elements of the type described in U.S. Pat. No. 4,975,354 without causing excessive loss in speed. The useful 2-substituted-4-hydroxy-1,3,3a,7-tetraazaindenes for this purpose are compounds of the formula:

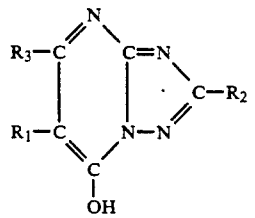

wherein $R_1$ and $R_3$ are, independently, hydrogen, halogen or alkyl and $R_2$ is alkyl of at least 7 carbon atoms or thioalkyl of at least 6 carbon atoms. Accordingly, this invention provides a novel silver halide photographic element, adapted to form a high contrast image when developed with an aqueous alkaline developing solution, which comprises:

(1) a hydrazine compound that functions as a nucleator, (2) an amino compound that functions as an incorporated booster, and (3) a tetraazaindene compound that functions as a pepper fog inhibitor, the tetraazaindene compound being a 2-substituted-4-hydroxy-1,3,3a,7-tetraazaindene of the formula hereinabove described.

Since the novel photographic elements of this invention have incorporated therein the hydrazine compound which functions as a nucleator, the amino compound which functions as a booster, and the tetraazaindene compound which functions to inhibit pepper fog, they are not dependent on the use of additives in the developing solution for any of these vital functions and can, accordingly, be processed with conventional, low cost, rapid access developers that are widely used in the field of graphic arts.

DESCRIPTION OF THE PREFERRED EMBODIMENTS

Any hydrazine compound that functions as a nucleator, is capable of being incorporated in the photographic element, and is capable of acting conjointly with the incorporated booster to provide high contrast, can be used in the practice of this invention. Typically, the hydrazine compound is incorporated in a silver halide emulsion used in forming the photographic element. Alternatively, the hydrazine compound can be present in a hydrophilic colloid layer of the photographic element, preferably a hydrophilic colloid layer which is coated to be contiguously adjacent to the emulsion layer in which the effects of the hydrazine compound are desired. It can, of course, be present in the photographic element distributed between or among emulsion and hydrophilic colloid layers, such as undercoating layers, interlayers and overcoating layers.

An especially preferred class of hydrazine compounds for use in the elements of this invention are the hydrazine compounds described in Machonkin et al, U.S. Pat. No. 4,912,016 issued Mar. 27, 1990. These compounds are aryl hydrazides of the formula:

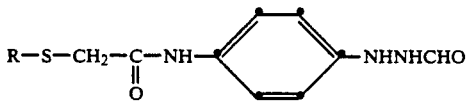

where R is an alkyl or cycloalkyl group.

Another especially preferred class of hydrazine compounds for use in the elements of this invention are the hydrazine compounds described in copending commonly assigned U.S. patent application Ser. No. 167,814, "High Contrast Photographic Element and Emulsion And Process For Their Use", by J. J. Looker, R. E. Leone and L. J. Fleckenstein, filed Mar. 14, 198 and issued Apr. 14, 1992, as U.S. Pat. No. 5,104,769. The disclosure of this application is incorporated herein by reference in its entirety.

The hydrazine compounds described in the aforesaid patent application Ser. No. 167,814 have one of the following structural formulae:

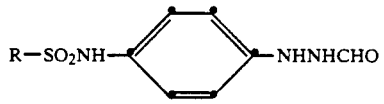

I or

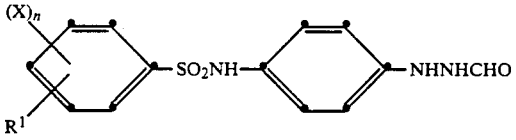

II wherein:

R is alkyl having from 6 to 18 carbon atoms or a heterocyclic ring having 5 or 6 ring atoms, including ring atoms of sulfur or oxygen;

$R^1$ is alkyl or alkoxy having from 1 to 12 carbon atoms;

X is alkyl, thioalkyl or alkoxy having from 1 to about 5 carbon atoms; halogen; or —NHCOR$^2$, —NHSO$_2$R$^2$, —CONR$^2$R$^3$ or —SO$_2$NR$^2$R$^3$ where R$^2$ and R$^3$, which can be the same or different, are hydrogen or alkyl having from 1 to about 4 carbon atoms; and n is 0, 1 or 2.

Alkyl groups represented by R can be straight or branched chain and can be substituted or unsubstituted. Substituents include alkoxy having from 1 to about 4 carbon atoms, halogen atoms (e.g. chlorine and fluorine), or —NHCOR$^2$ or —NHSO$_2$R$^2$ where R$^2$ is as defined above. Preferred R alkyl groups contain from about 8 to about 16 carbon atoms since alkyl groups of this size impart a greater degree of insolubility to the hydrazide nucleating agents and thereby reduce the tendency of these agents to be leached during development from the layers in which they are coated into developer solutions.

Heterocyclic groups represented by R include thienyl and furyl, which groups can be substituted with alkyl having from 1 to about 4 carbon atoms or with halogen atoms, such as chlorine.

Alkyl or alkoxy groups represented by $R^1$ can be straight or branched chain and can be substituted or unsubstituted. Substituents on these groups can be alkoxy having from 1 to about 4 carbon atoms, halogen atoms (e.g. chlorine or fluorine); or —NHCOR$^2$— or —NHSO$_2$R$^2$ where R$^2$ is as defined above. Preferred alkyl or alkoxy groups contain from 1 to 5 carbon atoms in order to impart sufficient insolubility to the hydrazide nucleating agents to reduce their tendency to being leached out of the layers in which they are coated by developer solution.

Alkyl, thioalkyl and alkoxy groups which are represented by X contain from 1 to about 5 carbon atoms and can be straight or branched chain. When X is halogen, it may be chlorine, fluorine, bromine or iodine. Where more than one X is present, such substituents can be the same or different.

Yet another especially preferred class of hydrazine compounds are aryl sulfonamidophenyl hydrazides containing ethyleneoxy groups which have the formula:

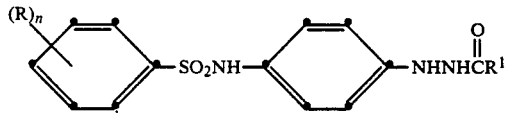

II where each R is a monovalent group comprised of at least three repeating ethyleneoxy units, n is 1 to 3, and $R^1$ is hydrogen or a blocking group.

These hydrazides are described in Machonkin and Kerr, U.S. Pat. No. 5,041,355, issued Au. 20, 1991.

Still another especially preferred class of hydrazine compounds are the compounds described in Machonkin and Kerr, U.S. Pat. No. 4,988,604 issued Jan. 29, 1991. These compounds are aryl sulfonamidophenyl hydrazides containing both thio and ethyleneoxy groups which have the formula:

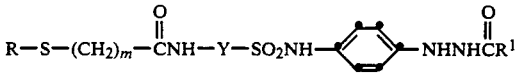

where R is a monovalent group comprised of at least three repeating ethyleneoxy units, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl.

A still further especially preferred class of hydrazine compounds are the compounds described in Looker and Kerr, U.S. Pat. No. 4,994,365, issued Feb. 19, 1991. These compounds are aryl sulfonamidophenyl hydrazides containing an alkyl pyridinium group which have the formula:

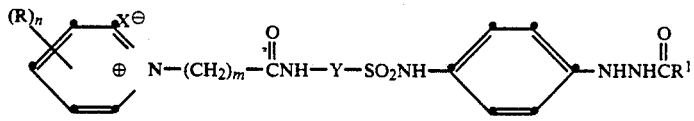

where each R is an alkyl group, preferably containing 1 to 12 carbon atoms, n is 1 to 3, X is an anion such as chloride or bromide, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl. Preferably, the sum of the number of carbon atoms in the alkyl groups represented by R is at least 4 and more preferably at least 8. The blocking group represented by $R^1$ can be, for example:

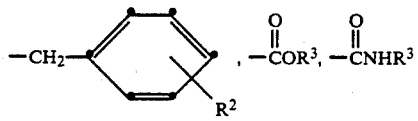

or

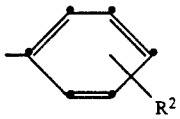

where $R^2$ is hydroxy or a hydroxy-substituted alkyl group having from 1 to 4 carbon atoms and $R^3$ is an alkyl group having from 1 to 4 carbon atoms.

While certain preferred hydrazine compounds that are useful in this invention have been specifically described hereinabove, it is intended to include within the scope of this invention all hydrazine compound "nucleators" known to the art. Many such nucleators are described in "Development Nucleation By Hydrazine And Hydrazine Derivatives", Research Disclosure, Item 23510, Vol. 235, Nov. 10, 1983 and in numerous patents including U.S. Pat. Nos. 4,166,742, 4,168,977, 4,221,857, 4,224,401, 4,237,214, 4,241,164, 4,243,739, 4,269,929, 4,272,606, 4,272,614, 4,311,781, 4,332,878, 4,358,530, 4,377,634, 4,385,108, 4,429,036, 4,447,522, 4,540,655, 4,560,638, 4,569,904, 4,618,572, 4,619,886, 4,634,661, 4,650,746, 4,681,836, 4,686,167, 4,699,873, 4,722,884, 4,725,532, 4,737,442, 4,740,452, 4,912,016, 4,914,003, 4,975,354, 4,988,604, 4,994,365, and 5,041,355.

The hydrazine compound utilized as a nucleator in this invention is usually employed in an amount of from about 0.005 millimoles to about 100 millimoles per mole of silver and more typically from about 0.1 millimoles to about 10 millimoles per mole of silver.

The hydrazine compounds are employed in this invention in combination with negative-working photographic emulsions comprised of radiation-sensitive silver halide grains capable of forming a surface latent image and a binder. Useful silver halides include silver chloride, silver chlorobromide, silver chlorobromoiodide, silver bromide and silver bromoiodide.

Silver halide grains suitable for use in the emulsions of this invention are capable of forming a surface latent image, as opposed to being of the internal latent image-forming type. Surface latent image silver halide grains are employed in the majority of negative-working silver halide emulsions, whereas internal latent image-forming silver halide grains, while capable of forming a negative image when developed in an internal developer, are usually employed with surface developers to form direct-positive images. The distinction between surface latent image and internal latent image silver halide grains is generally well recognized in the art.

The silver halide grains, when the emulsions are used for lith applications, have a mean grain size of not larger than about 0.7 micron, preferably about 0.4 micron or less. Mean grain size is well understood by those skilled in the art, and is illustrated by Mees and James, *The Theory of the Photographic Process,* 3rd Ed., MacMillan 1966, Chapter 1, pp. 36–43. The photographic emulsions can be coated to provide emulsion layers in the photographic elements of any conventional silver coverage. Conventional silver coverages fall within the range of from about 0.5 to about 10 grams per square meter.

As is generally recognized in the art, higher contrasts can be achieved by employing relatively monodispersed emulsions. Monodispersed emulsions are characterized by a large proportion of the silver halide grains falling within a relatively narrow size-frequency distribution. In quantitative terms, monodispersed emulsions have been defined as those in which 90 percent by weight or by number of the silver halide grains are within plus or minus 40 percent of the mean grain size.

Silver halide emulsions contain, in addition to silver halide grains, a binder. The proportion of binder can be widely varied, but typically is within the range of from about 20 to 250 grams per mol of silver halide. Excessive binder can have the effect of reducing maximum densities and consequently also reducing contrast. For contrast values of 10 or more, it is preferred that the binder be present in a concentration of 250 grams per mol of silver halide, or less.

The binders of the emulsions can be comprised of hydrophilic colloids. Suitable hydrophilic materials include both naturally occurring substances such as proteins, protein derivatives, cellulose derivatives, e.g., cellulose esters, gelatin, e.g., alkali-treated gelatin (pigskin gelatin) gelatin derivatives, e.g., acetylated gelatin, phthalated gelatin and the like, polysaccharides such as dextran, gum arabic, zein, casein, pectin, collagen derivatives, collodion, agar-agar, arrowroot, albumin and the like.

In addition to hydrophilic colloids, the emulsion binder can be optionally comprised of synthetic polymeric materials which are water insoluble or only slightly soluble, such as polymeric latices. These materials can act as supplemental grain peptizers and carriers, and they can also advantageously impart increased dimensional stability to the photographic elements. The synthetic polymeric materials can be present in a weight ratio with the hydrophilic colloids of up to 2:1. It is generally preferred that the synthetic polymeric materials constitute from about 20 to 80 percent by weight of the binder.

Suitable synthetic polymer materials can be chosen from among poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridines, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialylaminoalkyl acrylates, vinyl imidazole copolymers, vinyl sulfide copolymers, halogenated styrene polymers, amineacrylamide polymers, polypeptides and the like.

Although the term "binder" is employed in describing the continuous phase of the silver halide emulsions, it is recognized that other terms commonly employed by those skilled in the art, such as carrier or vehicle, can be interchangeably employed. The binders described in connection with the emulsions are also useful in forming undercoating layers, interlayers and overcoating layers of the photographic elements of the invention. Typically the binders are hardened with one or more hardeners, such as those described in Paragraph VII, Product Licensing Index, Vol. 92, December 1971, Item 9232, which disclosure is hereby incorporated by reference.

Emulsions according to this invention having silver halide grains of any conventional geometric form (e.g. regular cubic or octahedral crystalline form) can be prepared by a variety of techniques, e.g., single-jet, double-jet (including continuous removal techniques), accelerated flow rate and interrupted precipitation techniques, as illustrated by Trivelli and Smith, *The Photographic Journal*, Vol. LXXIX, May, 1939, pp. 330–338, T. H. James, *The Theory of the Photographic Process*, 4th Ed., MacMillan, 1977, Chapter 3; Terwilliger et al Research Disclosure, Vol. 149, September 1976, Item 14987, as well as U.S. Pat. Nos. 2,222,264; 3,650,757; 3,672,900; 3,917,485; 3,790,387; 3,761,276 and 3,979,213, and German OLS No. 2,107,118 and U. K. Patent Publications 335,925, 1,430,465 and 1,469,480, which publications are incorporated herein by reference.

It is particularly preferred that the silver halide grains are doped to provide high contrast. As is known in the art, use of a suitable doping agent, in concert with the use of a hydrazine compound that functions as a nucleator, is capable of providing an extremely high contrast response. Doping agents are typically added during the crystal growth stages of emulsion preparation, for example, during initial precipitation and/or physical ripening of the silver halide grains. Rhodium is a particularly effective doping agent, and can be incorporated in the grains by use of suitable salts such as rhodium trichloride. Rhodium-doping of the silver halide grains employed in this invention is especially beneficial in facilitating the use of chemical sensitizing agents without encountering undesirably high levels of pepper fog. Doping agents described in McDugle et al, U.S. Pat. No. 4,933,272 as being useful in graphic arts emulsions, can also be advantageously employed. These are hexacoordinated complexes of the formula:

$$[M'(NO)(L')_5]^m$$

wherein m is zero, −1, −2, or −3.

M′ represents chromium, rhenium, ruthenium, osmium or iridium, and

L′ represents one or a combination of halide and cyanide ligands or a combination of these ligands with up to two aquo ligands.

The silver halide emulsions can be chemically sensitized with active gelatin, as illustrated by T.H. James, *The Theory of the Photographic Process*, 4th Ed., MacMillan, 1977, pp. 67–76, or with sulfur, selenium, tellurium, platinum, gold, palladium, iridium, osmium, rhenium or phosphorus sensitizers or combinations of these sensitizers, such as at pAg levels of from 5 to 10, pH levels of from 5 to 8 and temperatures of from 30° to 80° C., as illustrated by *Research Disclosure*, Vol. 134, June 1975, Item 13452. The emulsions need not be chemically sensitized, however, in order to exhibit the advantages of this invention.

The silver halide emulsions can be spectrally sensitized with dyes from a variety of classes, including the polymethine dye class, which includes the cyanines, merocyanines, complex cyanines and merocyanines, (i.e., tri-, tetra- and polynuclear cyanines and merocyanines), oxonols, hemioxonols, styryls, merostyryls and streptocyanines.

A particularly preferred method of achieving chemical sensitization is by use of a combination of a gold compound and a urea compound as described in copending commonly assigned U.S. patent application Ser. No. 735,979, filed Jul. 25, 1991, entitled "Nucleated High Contrast Photographic Elements Containing Urea Compounds Which Enhance Speed And Increase Contrast", by Anthony Adin. This method provides exceptional results when used with high-chloride silver halide emulsions, i.e., those in which at least the surface portion of the silver halide grains is composed of more than 50 mole percent silver chloride. The combination of the gold compound and urea compound functions to enhance speed and increase contrast in the toe region of the sensitometric curve, without a concurrent increase in fog. Urea compounds effective for this purpose are 1,1,3,3-tetra-substituted middle chalcogen urea compounds in which at least one substituent comprises a nucleophilic center. A combination of potassium tetrachloroaurate and 1,3-dicarboxymethyl-1,3-dimethyl-2-thiourea is especially effective.

Chemical sensitization can also be provided by use of a combination of a gold compound and a thiourea compound as described in copending commonly assigned U.S. patent application Ser. No. 825,349, filed Jan. 24, 1992, "Nucleated High Contrast Photographic Elements Containing Substituted Thioureas Which Enhance Speed And Increase Contrast", by Anthony Adin.

The photographic system to which this invention pertains is one which employs a hydrazine compound as a nucleating agent and an amino compound as an incorporated booster. Amino compounds which are particularly effective as incorporated boosters are described in Machonkin and Kerr, U.S. Pat. No. 4,975,354, issued Dec. 4, 1990.

The amino compounds useful as incorporated boosters described in U.S. Pat. No. 4,975,354 are amino compounds which:

(1) comprise at least one secondary or tertiary amino group;

(2) contain within their structure a group comprised of at least three repeating ethyleneoxy units, and (3) have a partition coefficient (as hereinafter defined) of at least one, preferably at least three, and most preferably at least four.

Included within the scope of the amino compounds utilized in this invention as incorporated boosters are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amino compounds employed in this invention as incorporated boosters are compounds of at least 20 carbon atoms.

Preferred amino compounds for use as incorporated boosters are bis-tertiary-amines which have a partition coefficient of at least three and a structure represented by the formula:

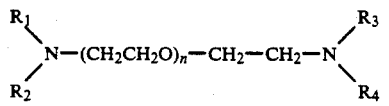

wherein n is an integer with a value of 3 to 50, and more preferably 10 to 50, $R_1$, $R_2$, $R_3$ and $R_4$ are, independently, alkyl groups of 1 to 8 carbon atoms, $R_1$ and $R_2$ taken together represent the atoms necessary to complete a heterocyclic ring, and $R_3$ and $R_4$ taken together represent the atoms necessary to complete a heterocyclic ring.

Another advantageous group of amino compounds for use as incorporated boosters are bis-secondary amines which have a partition coefficient of at least three and a structure represented by the formula:

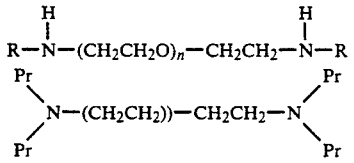

~14 wherein n is an integer with a value of 3 to 50, and more preferably 10 to 50, and each R is, independently, a linear or branched, substituted or unsubstituted, alkyl group of at least 4 carbon atoms.

Preferably the group comprised of at least three repeating ethyleneoxy units is directly linked to a tertiary amino nitrogen atom and most preferably the group comprised of at least three repeating ethyleneoxy units is a linking group joining tertiary amino nitrogen atoms of a bis-tertiary-amino compound.

The most preferred amino compound for use in this invention as an incorporated booster is a compound of the formula:

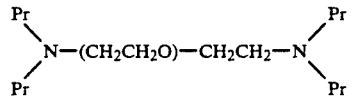

~14 where Pr represents n-propyl.

Other amino compounds useful as incorporated boosters are described in Yagihara et al, U.S. Pat. No. 4,914,003 issued Apr. 3, 1990. The amino compounds described in this patent are represented by the formula:

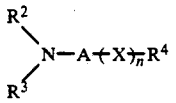

wherein $R^2$ and $R^3$ each represent a substituted or unsubstituted alkyl group or may be linked to each other to form a ring; $R^4$ represents a substituted or unsubstituted alkyl, aryl or heterocyclic group; A represents a divalent linkage; X represents $—CONR^5—$, $—O—CONR^5$, $—NR^5CONR^5$, $—NR^5COO—$, $—COO—$, $—OCO—$, $—CO—$, $—NR^5CO—$, $—SO_2NR^5—$, $—NR^5SO_2—$, $—SO_2—$, —S— or —O— group in which $R^5$ represents a hydrogen atom or a lower alkyl group and n represents 0 or 1, with the proviso that the total number of carbon atoms contained in $R^2$, $R^3$, $R^4$ and A is 20 or more.

The amino compound utilized as an incorporated booster is typically employed in an amount of from about 0.1 to about 25 millimoles per mole of silver, and more preferably in an amount of from about 0.5 to about 15 millimoles per mole of silver.

As hereinabove described, the present invention is based on the discovery that 2-substituted-4-hydroxy-1,3,3a,7-tetraazaindenes of the formula:

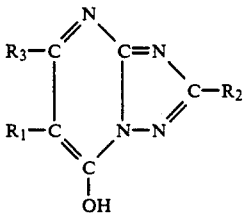

wherein $R_1$ and $R_3$ are, independently, hydrogen, halogen or alkyl and $R_2$ is alkyl of at least 7 carbon atoms or thioalkyl of at least 6 carbon atoms, are highly effective in inhibiting pepper fog in a high contrast photographic system that employs a hydrazine compound as a nucleator and an amino compound as an incorporated booster.

In the above formula, when either of $R_1$ or $R_3$ is alkyl it preferably contains 1 to 12 carbon atoms and more preferably 1 to 4 carbon atoms; $R_2$ is alkyl of at least 7 carbon atoms, and preferably 7 to 12 carbon atoms, or thioalkyl of at least 6 carbon atoms, and preferably 6 to 12 carbon atoms. As used herein, the term "thioalkyl" includes thioalkyl groups having one or more sulfur atoms. It is preferred that $R_3$ be alkyl and particularly preferred that $R_3$ be methyl. It is preferred that $R_1$ be halogen and particularly preferred that $R_1$ be bromo.

Typical specific examples of 2-substituted-4-hydroxy-1,3,3a,7-tetraazaindenes useful in this invention include the following:

I

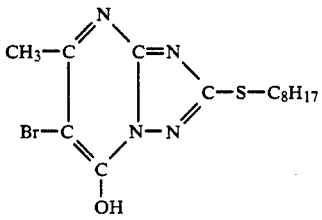

-continued

II

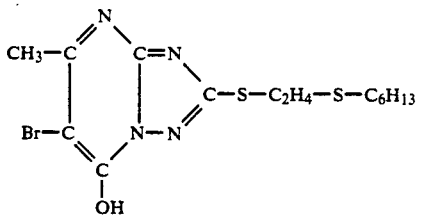

III

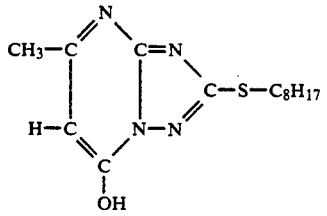

IV

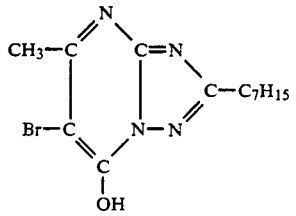

V

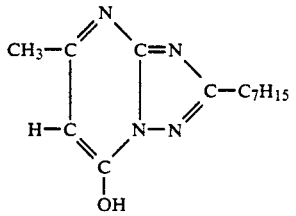

VI

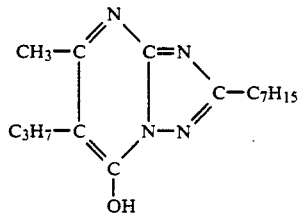

Preferably, the photographic elements of this invention contain both a speed-enhancing tetraazaindene and a pepper-fog-inhibiting tetraazaindene. Useful pepper-fog-inhibiting tetraazaindenes are of the formula hereinabove described. Useful speed-enhancing tetraazaindenes are of the formula:

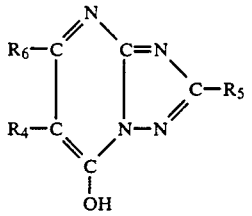

wherein $R_4$ and $R_6$ are, independently, hydrogen, alkyl, halogen, or carboxyl and $R_5$ is hydrogen, methyl or thiomethyl.

The 2-substituted-4-hydroxy-1,3a, 7-tetraazaindenes utilized as pepper fog inhibitors in this invention are typically employed in an amount of from about 0.1 to about 25 millimoles per mole of silver, and more preferably in an amount of from about 0.2 to about 5 millimoles per mole of silver.

Particularly preferred sensitizing dyes for use in this invention are the benzimidazolocarbocyanine dyes described in copending commonly assigned U.S. patent application Ser. No. 735,484, filed Jul. 25, 1991, "Nucleated High Contrast Photographic Elements Containing Low-Stain Sensitizing Dyes", by Anthony Adin, Linda J. Knapp, and Steven G. Link. These dyes provide enhanced photographic sensitivity, yet leave substantially no sensitizing dye stain after rapid access processing.

The benzimidazolocarbocyanine sensitizing dyes described in the aforesaid patent application are benzimidazolocarbocyanine sensitizing dyes having at least one acid-substituted alkyl group attached to a nitrogen atom of a benzimidazole ring. Preferred examples of such dyes are those of the formula:

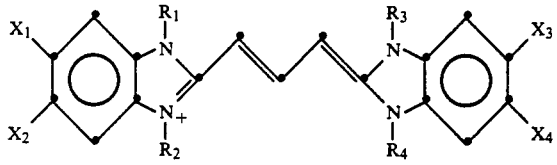

wherein $X_1$, $X_2$, $X_3$ and $X_4$ are, independently, hydrogen, cyano, alkyl, halo, haloalkyl, alkylthio, alkoxycarbonyl, aryl, carbamoyl or substituted carbamoyl, $R_1$ and $R_3$ are alkyl, and $R_2$ and $R_4$ are, independently, alkyl, alkenyl, substituted alkyl or substituted alkenyl with the proviso that at least one of $R_2$ and $R_4$ is acid-substituted alkyl and with the further proviso that when both $R_2$ and $R_4$ are acid-substituted alkyl, there is also a cation present to balance the charge.

The term "partition coefficient", as used herein, refers to the log P value of the compound with respect to the system n-octanol/water as defined by the equation:

$$\log P = \log \frac{[X]_{n\text{-}octanol}}{[X]_{water}}$$

where X=concentration of the compound. The partition coefficient is a measure of the ability of a compound to partition between aqueous and organic phases and is calculated in the manner described in an article by A. Leo, P.Y.C. Jow, C. Silipo and C. Hansch, Journal of Medicinal Chemistry, Vol. 18, No. 9, pp. 865–868, 1975. Calculations for log P can be carried out using MedChem software, version 3.54, Pomona College, Claremont, Calif. The higher the value of log P, the more hydrophobic the compound. Compounds with a log P of greater than zero are hydrophobic, i.e., they are more soluble in organic media than in aqueous media, whereas compounds with a log P of less than zero are hydrophilic. A compound with a log P of one is ten times more soluble in organic media than in aqueous media, and a compound with a log P of two is one hundred times more soluble in organic media than in aqueous media.

The invention is further illustrated by the following examples of its practice. In these examples, reference is made to emulsion addenda having structures as indicated below:
CS-1
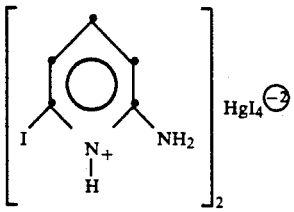
CS-2
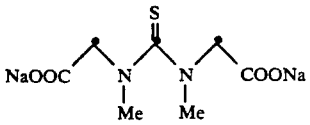
$KAuCl_4$ CS-3
A-1
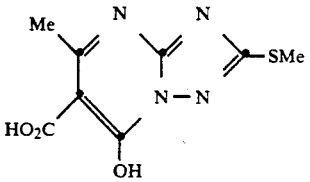
A-2
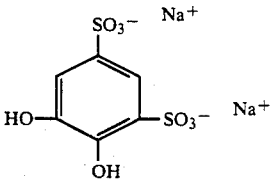
A-3
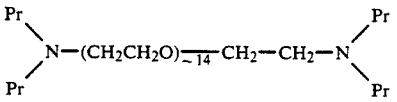
A-4
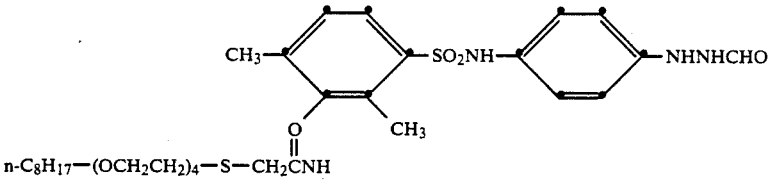
A-5
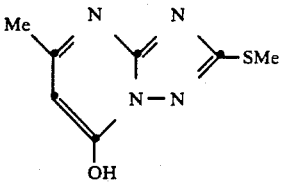
A-6
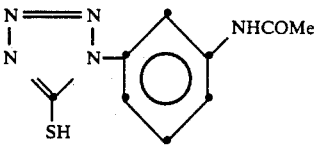

-continued

A-7

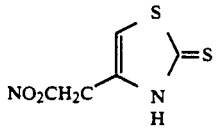

B-1

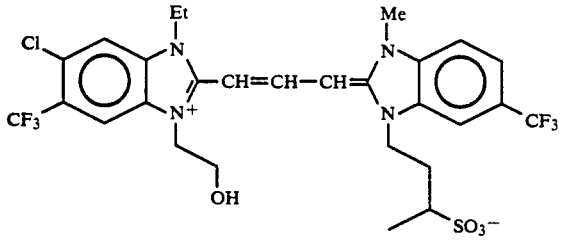

In the formulae given above, "Me" represents methyl, "Et" represents ethyl and "Pr" represents n-propyl.

EXAMPLES 1 AND 2

A 0.22 micron edge length, rhodium-doped (0.018 mg Rh/mole Ag) cubic AgClBr (70/30) emulsion was chemically sensitized by heating for 10 minutes at 65° C. in the presence of 0.14 mg/Ag mole of CS-1, 3 mg/Ag mole of CS-2 and 2 mg/Ag mole of CS-3. The emulsion was then dyed with 235 mg/Ag mole of B-1 and held for 20 minutes at 40° C. before adding gelatin and a latex polymer (a copolymer of methyl acrylate, 2-acrylamido-2-methylpropane sulfonic acid and 2-acetoacetoxyethylmethacrylate) plus 500 mg/Ag mole of A-1, 3.6 g/Ag mole of A-2, 2 g/Ag mole of A-3 and 0.2 mmole/Ag mole of A-4. The emulsion was coated on polyester support to give a silver laydown of 3.44 g/m$^2$, a gelatin laydown of 2.69 g/m$^2$ and a latex polymer laydown of 1.29 g/m$^2$. The emulsion layer was overcoated with 0.88.g/m$^2$ of gelatin and hardened with 2 wt % bis-vinylsulfonylmethane with respect to the total gelatin.

Film samples were prepared from the above-described emulsion, which is referred to as the Control in Table I below, and these films were exposed for 5 seconds by a 3000K tungsten source through a continuous wedge target and developed for 35 seconds at 35° C.

To prepare the developer solution, a concentrate was prepared from the following ingredients:

| | |
|---|---|
| Sodium metabisulfite | 145 g |
| 45% Potassium hydroxide | 178 g |
| Diethylenetriamine pentaacetic acid pentasodium salt (49% solution) | 15 g |
| Sodium bromide | 12 g |
| Hydroquinone | 65 g |
| 1-Phenyl-4-hydroxymethyl-4-methyl-3-pyrazolidone | 2.9 g |
| Benzotriazole | 0.4 g |
| 1-Phenyl-5-mercaptotetrazole | 0.05 g |
| 50% Sodium hydroxide | 46 g |
| Boric acid | 6.9 g |
| Diethylene glycol | 120 g |
| 47% Potassium carbonate | 120 g |
| Water to one liter | |

The concentrate was diluted at a ratio of one part of concentrate to three parts of water to produce a working strength developing solution with a pH of 10.5.

The photographic speeds (100×Log spectral sensitivity) of the films were measured at 0.1 and 4.0 density units above fog. The slopes of the lines joining the density points of 0.1 and 0.6 above fog (toe contrast) were also recorded. The number of pepper spots was deliberately increased by raising the developer pH 0.5 units with NaOH and measured on an electronic image analyzer which counted the number of spots greater than 10 microns in diameter in an area of 600 square millimeters. The results obtained are summarized in Table I. In this table, Comparison 1 was the same as the Control except that it additionally contained 100 mg/Ag mole of the thione compound A-6. Example 1 was the same as the Control except that it additionally contained 200 mg/Ag mole of Compound I. Example 2 was the same as the Control except that it additionally contained 200 mg/Ag mole of Compound II.

TABLE I

| Example No. | Speed at 0.1 above Fog | Speed at 4.0 above Fog | Toe Contrast | Number of Spots |
|---|---|---|---|---|
| Control | 2.30 | 2.18 | 16.3 | 467 |
| Comparison 1 | 2.25 | 2.07 | 13.6 | 173 |
| Example 1 | 2.28 | 2.13 | 16.3 | 147 |
| Example 2 | 2.27 | 2.09 | 13.9 | 161 |

Considering the data in Table I, it is apparent that the fog-inhibiting tetraazaindenes utilized in Example 1 and 2 reduced pepper fog with less speed loss and contrast loss than the thione employed in Comparison 1.

EXAMPLES 3 TO 7

A second set of films was prepared, exposed, developed and tested in the same manner as described above and the results obtained are reported in Table II. Comparison 2 was the same as the Control except that it additionally contained 400 mg/Ag mole of Compound A-5. Comparisons 3 and 4 were the same as the Control except that they additionally contained, respectively, 25 mg/Ag mole and 50 mg/Ag mole of the thione Compound A-7. Example 3 was the same as the Control except that it additionally contained 200 mg/Ag mole of Compound III. Example 4 was the same as the Control except that it additionally contained 200 mg/Ag mole of Compound I. Example 5 was the same as the Control except that it additionally contained 100 mg/Ag mole of Compound IV. Example 6 was the same as the Control except that it additionally contained 200 mg/Ag mole of Compound V. Example 7 was the same as the Control except that it additionally contained 200 mg/Ag mole of Compound VI.

TABLE II

| Example No. | Speed at 0.1 above Fog | Speed at 4.0 above Fog | Toe Contrast | Number of Spots |
|---|---|---|---|---|
| Comparison 2 | 2.36 | 2.21 | 12.9 | 599 |
| Comparison 3 | 2.29 | 2.12 | 12.2 | 264 |
| Comparison 4 | 2.25 | 2.03 | 10.3 | 205 |
| Example 3 | 2.32 | 2.15 | 12.1 | 290 |
| Example 4 | 2.33 | 2.17 | 12.5 | 219 |
| Example 5 | 2.35 | 2.20 | 11.5 | 317 |
| Example 6 | 2.33 | 2.19 | 13.6 | 389 |
| Example 7 | 2.32 | 2.15 | 12.4 | 186 |

Considering the data in Table II, it is apparent that Examples 3 to 7 demonstrate that the 2-substituted-4-hydroxy-1,3,3a,7-tetraazaindenes of this invention are effective in reducing the number of pepper fog spots. Use of the thione A-7 was less effective than use of the 2-substituted-4-hydroxy-1,3,3a,7-tetraazaindenes of this invention in regard to reducing pepper fog without adversely affecting speed and/or contrast.

Use of 2-substituted-4-hydroxy-1,3,3a,7-tetraazaindenes in accordance with the teachings of this invention provides many important benefits in the field of graphic arts. These compounds provide a means to effectively control pepper fog in nucleated high contrast elements. They are effective with all the different types of silver halides utilized in high contrast photographic elements for the graphic arts. By using them in combination with hydrazine compounds that function as nucleators and amino compounds that function as incorporated boosters, the resulting photographic system provides high speed, high contrast, low pepper fog, good discrimination, freedom from seasoning effects, good dot quality and minimal chemical spread. These benefits are achieved with the hydrazine compound, the amino compound, and the tetraazaindene compound all being incorporated in the photographic element, so that conventional low cost developing solutions can be employed.

The invention has been described in detail with particular reference to preferred embodiments thereof, but it will be understood that variations and modifications can be effected within the spirit and scope of the invention.

What is claimed is:

1. A silver halide photographic element adapted to form a high contrast image when developed with an aqueous alkaline developing solution; said element comprising:

(1) a hydrazine compound that functions as a nucleator, (2) an amino compound that functions as an incorporated booster, and (3) a tetraazaindene compound that functions as a pepper fog inhibitor, said tetraazaindene compound being a 2-substituted-4-hydroxy-1,3,3a,7-tetraazaindene of the formula:

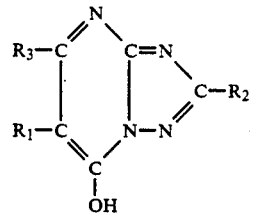

wherein $R_1$ is halogen, $R_3$ is hydrogen, halogen or alkyl and $R_2$ is alkyl of at least 7 carbon atoms or thioalkyl of at least 6 carbon atoms.

2. A silver halide photographic element as claimed in claim 1 wherein $R_2$ is alkyl of 7 to 12 carbon atoms.

3. A silver halide photographic element as claimed in claim 1 wherein $R_2$ is thioalkyl of 6 to 12 carbon atoms.

4. A silver halide photographic element as claimed in claim 1 wherein $R_3$ is methyl.

5. A silver halide photographic element as claimed in claim 1 wherein $R_1$ is bromo.

6. A silver halide photographic element as claimed in claim 1 wherein said hydrazine compound is an aryl sulfonamidophenyl hydrazide of the formula:

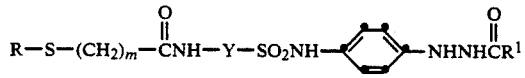

where R is a monovalent group comprised of at least three repeating ethyleneoxy units, m is 1 to 6, Y is a divalent aromatic radical, and $R_1$ is hydrogen or a blocking group.

7. A silver halide photographic element as claimed in claim 1 wherein said amino compound is a compound which (1) comprises at least one secondary or tertiary amino group, (2) contains within its structure a group comprised of at least three repeating ethyleneoxy units, and (3) has a partition coefficient of at least one.

8. A silver halide photographic element as claimed in claim 1 wherein said amino compound is a bis-tertiary amine of the formula:

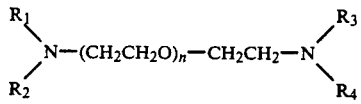

wherein n is an integer with a vadlue of 3 to 50, $R_1$, $R_2$, $R_3$ and $R_4$ are independently alkyl groups of 1 to 8 carbon atoms, $R_1$ and $R_2$ taken together and $R_3$ and $R_4$ taken together represent the atoms necessary to complete a heterocyclic ring.

9. A silver halide photographic element as claimed in claim 1 wherein said amino compound is a bis-secondary amine of the formula:

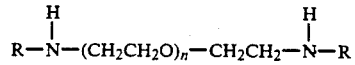

-continued

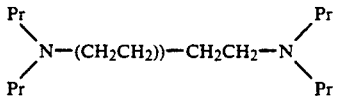

~14 wherein n is an integer with a value of 3 to 50 and each R is independently a linear or branched, substituted or unsubstituted alkyl group of at least 4 carbon atoms.

10. A silver halide photographic element as claimed in claim 1 wherein said 2-substituted-4-hydroxy-1,3,3a,7-tetraazaindene has the formula:

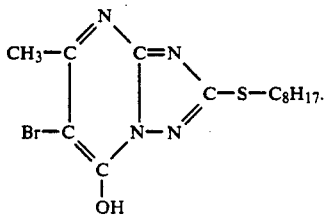

11. A silver halide photographic element as claimed in claim 1 wherein said 2-substituted-4-hydroxy-1,3,3a,7-tetraazaindene has the formula:

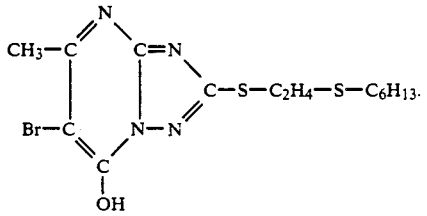

12. A silver halide photographic element as claimed in claim 1 additionally comprising a speed-enhancing tetraazaindene of the formula:

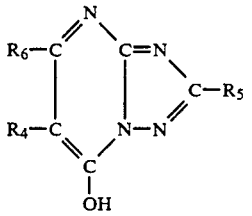

wherein $R_4$ and $R_6$ are independently, hydrogen, alkyl, halogen or carboxyl and $R_5$ is hydrogen, methyl or thiomethyl.

13. A silver halide photographic element as claimed in claim 1 additionally comprising a speed-enhancing tetraazaindene of the formula:

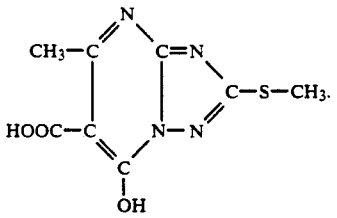

14. A silver halide photographic element as claimed in claim 1 wherein said hydrazine compound is present in an amount of from about 0.1 to about 10 millimoles per mole of silver, said amino compound is present in an amount of from about 1 to about 25 millimoles per mole of silver, and said 2-substituted- 4-hydroxy-1,3,3a,7-tetraazaindene is present in an amount of from about 0.2 to about 5 millimoles per mole of silver.

15. A silver halide photographic element as claimed in claim 1 wherein said silver halide has a mean grain size of about 0.4 microns or less.

16. A silver halide photographic element as claimed in claim 1 wherein said silver halide is silver bromide or silver bromoiodide.

17. A silver halide photographic element as claimed in claim 1 wherein said silver halide is silver chloride, silver chlorobromide or silver chlorobromoiodide.

18. A silver halide photographic element adapted to form a high contrast image when developed with an aqueous alkaline developing solution, said element comprising:

(1) a hydrazine compound that functions as a nucleator, said hydrazine compound having the formula:

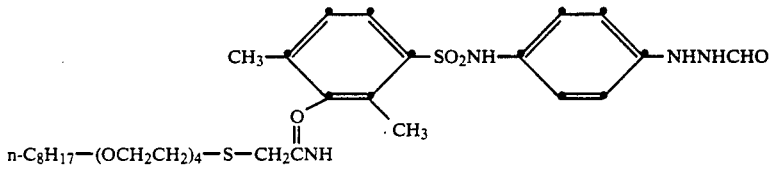

(2) an amino compound that functions as an incorporated booster, said amino compound having the formula:

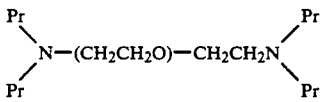

~14 where Pr represents n-propyl, and (3) a 2-substituted-4-hydroxy-1,3,3a,7-tetraazaindene that functions as a pepper fog inhibitor, said 2-substituted-4-hydroxy-1,3,3a,7-tetraazaindene having the formula:

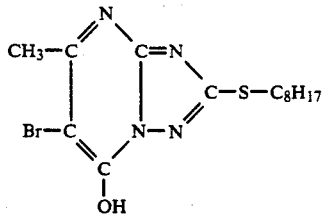

19. A silver halide photographic element adapted to form a high contrast image when developed with an aqueous alkaline developing solution, said element comprising:

(1) a hydrazine compound that functions as a nucleator, said hydrazine compound having the formula:

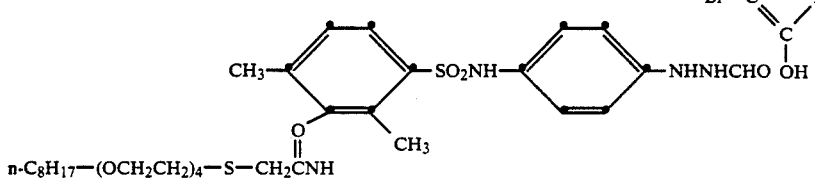

(2) an amino compound that functions as an incorporated booster, said amino compound having the formula:

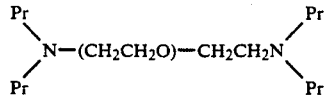

~14 where Pr represents n-propyl, and (3) a 2-substituted-4-hydroxy-1,3,3a,7-tetraazaindene that functions as a pepper fog inhibitor, said 2-substituted-4-hydroxy-1,3,3a,7tetraaazaindene having the formula:

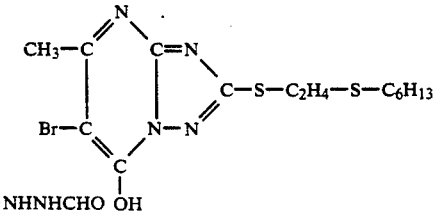

* * * * *